US005637060A

United States Patent [19]

de Souza

[11] Patent Number: 5,637,060

[45] Date of Patent: Jun. 10, 1997

[54] APPARATUS FOR PERFORMING MULTIPLE THERAPEUTIC AND PHYSICAL CONDITIONING EXERCISES

[76] Inventor: Antonio A. I. de Souza, Rua Gracindo de sa no. 71, Sao Paulo, Brazil

[21] Appl. No.: 588,828

[22] Filed: Jan. 19, 1996

Related U.S. Application Data

[63] Continuation of Ser. No. 280,164, Jul. 25, 1994, abandoned.

[30] Foreign Application Priority Data

Aug. 2, 1993 [BR] Brazil ..... 7301241 U

[51] Int. Cl.[6] ..... A63B 22/20

[52] U.S. Cl. ..... 482/70; 482/69; 482/131

[58] Field of Search ..... 482/69, 70, 71, 482/72, 131, 907; 601/23, 31–33

[56] References Cited

U.S. PATENT DOCUMENTS

| | | | |
|---|---|---|---|
| 1,982,843 | 12/1934 | Traver | 482/70 |
| 2,646,282 | 7/1953 | Ringman | 482/70 |
| 2,772,881 | 12/1956 | Fundom | 482/70 |
| 3,559,986 | 2/1971 | Ehrmantraut | 482/70 |
| 4,252,063 | 2/1981 | Brooks, Jr. | 482/69 |
| 4,529,194 | 7/1985 | Haaheim | 482/70 |
| 4,545,575 | 10/1985 | Forjot | 482/69 |
| 4,684,121 | 8/1987 | Nestegard | 482/70 |
| 4,826,152 | 5/1989 | Lo | 482/70 |
| 5,181,894 | 1/1993 | Shieng | 482/70 |
| 5,190,505 | 3/1993 | Dalebout et al. | 482/70 |
| 5,195,935 | 3/1993 | Fenal | 482/70 |
| 5,224,909 | 7/1993 | Hamilton | 482/70 |

FOREIGN PATENT DOCUMENTS

| | | | |
|---|---|---|---|
| 612526 | 1/1961 | Canada | 482/69 |
| 886915 | 12/1981 | U.S.S.R. | 482/71 |
| 1496809 | 7/1989 | U.S.S.R. | 482/69 |

OTHER PUBLICATIONS

Advertisement on Ski–Master XC1 and Ski–Master XC2, pre–Apr. 1994, 1 page.

Advertisement on Life Strider™ pre–Apr. 1994, 1 page.

*Primary Examiner*—Jeanne M. Clark

*Attorney, Agent, or Firm*—Skjerven, Morrill, MacPherson, Franklin & Friel; Thomas S. MacDonald

[57] ABSTRACT

An apparatus for performing multiple therapeutic and physical conditioning exercises includes a shaped base defining two pairs of C-shaped rails interconnected by metal cross-beams thereunder. This structure is closed both in the front and rear by finishing plates including tubular segments at each end. A pair of inverted U-shaped skates provided with tubular segments on their outer walls move independently over the rails. A pair of tilted poles extend upwardly from the skate tubular segments. A pair of parallel bars may extend parallel to the base at various regulated heights thereabove and are supported by and connected to poles or pairs of U-shaped bars fixed in the base tubular segments. The U-shaped bars may support a pair of upper rails over which a weight-supporting skate is moved. The support skate is provided on its top with a transverse rod for the attachment of a suspension vest worn by the exercising person or person performing therapeutic exercises.

7 Claims, 3 Drawing Sheets

APPARATUS FOR PERFORMING MULTIPLE THERAPEUTIC AND PHYSICAL CONDITIONING EXERCISES

This application is a continuation of application Ser. No. 08/280,164, filed Jul. 25, 1994, now abandoned

BACKGROUND OF THE INVENTION

The present invention is directed to an apparatus for performing multiple therapeutic and physical conditioning exercises. The apparatus provides for the possibility of independently performing aerobic or anaerobic exercises for the purpose of physical conditioning or physiotherapy in a single array of components with the user having the ability to regulate the resistance applied to the exercise.

Heretofore aerobic exercisers, such as the Ski-Master™ cross-country Ski-Simulator available from the Weider Institute of Chester, Conn. involve the pivoting of a pair of poles about a pivot intermediate of the poles length, the pivot having an adjustable resistance. The poles are connected to foot-pads simulating a ski-surface, each foot-pad containing a single wheel riding on the top of an elongated base rail. Another exerciser known as a LIFE STRIDER™ exerciser includes a pair of poles pivoted to foot-pad with a pair of side-by-side foot-pads which exerciser includes an adjustable torque mechanism.

Other prior art apparatuses are characterized by having poles attached to a specific device to be mounted on the base of the apparatus without being connected to skates, which devices are designed for providing resistance to the movement of the user's arms. In such devices, the resistance to the movement of the user's legs is generally provided for by a device different from those described above.

As can be seen these prior art exercisers include specific resistance-developing mechanisms common to the movements of the user's arms and legs.

SUMMARY OF THE INVENTION

The result of the structural feature of the present apparatus—which is the connection of poles to relevant skates, thus making out a pair of "pole/skate" sets—is the combination of the movements of the user's arms and legs in such a way that the combined movement may be made easy (assisted exercise) if the efforts made by arms and legs are directed to the same direction, and the combined movement may be made difficult (resisted exercise) if such efforts are directed to opposite directions.

Besides making it possible to perform both assisted and resisted exercises, such functional features allow for the performing of passive self-applied exercises, thus turning the present apparatus specifically indicated for use in the therapeutic field and differentiating same from similar apparatuses not provided with said features. Structurally, the main feature which makes it different from similar apparatuses (ski simulators) is that the poles provided for the movement of the user's arms are solely and directly attached to the roller skates provided for the movement of the user's legs, thus making out a pair of "pole/skate" sets.

Another feature of the present apparatus is that it may be optionally used as a skate simulator, being sufficient in this case to remove the poles which are attached to the skates by means of an anchoring bolt. In such conditions, aerobic exercises may be performed with or without resistance, being enough in the former case to use some of the implements used for such purpose, such as wrist or ankle weights, dumbbells or barbells, or elastic expanders.

The most prominent advantages of the apparatus are:

1—Versatility: the possibility of varying the position of the user's body on the skates (facing forward, backward, diagonally or laterally) and the position of the user's hands on the poles makes it possible to perform a multiplicity of exercises in many different ways.

2—Efficiency: the possibility of simultaneously performing aerobic, muscle stretching and muscle strengthening exercises combined in a number of ways makes it possible to save time.

Such advantages tend to reduce the monotony of the exercises, thus increasing the motivation and interest level.

The present invention provides an apparatus for performing therapeutic and physical conditioning exercises which eliminates the problems and drawbacks mentioned above. The apparatus is basically comprised of a rectangular shaped base defining two pairs of C-shaped rails interconnected by metal crossbeams transversely extending underneath the rails. This structure is closed both in the front and rear by a finishing plate. Positioned at ends of each plate are S welded tubular segments having anchoring bolts. A pair of inverted U-shaped skates provided on their outer side walls with similar tubular segments having anchoring bolts move independently over the rails. The user stands on the skates. A pair of tilted poles each having a short straight lower segment are connected to the plate tubular segments. Two pairs of ancillary feet each comprised of welded tubular lengths extend from base corners. Further, a pair of parallel bars provided with fastening bolts for regulating the height thereof may be connected to other tilted poles or pairs of U bars. In another embodiment a supporting sub-assembly formed by a pair of inverted U bars may be coupled to the ancillary feet and support a pair of upper rails over which a support skate is moved. The support skate is provided on its top with a transverse rod for the attachment of a suspension vest worn by the user and whose feet are on the skates movable on the lower rails.

BRIEF DESCRIPTION OF THE DRAWINGS

In order to better understand the present invention, it will be described as follows with regard to the attached drawings, wherein.

DETAILED DESCRIPTION OF THE INVENTION

Figure 1:
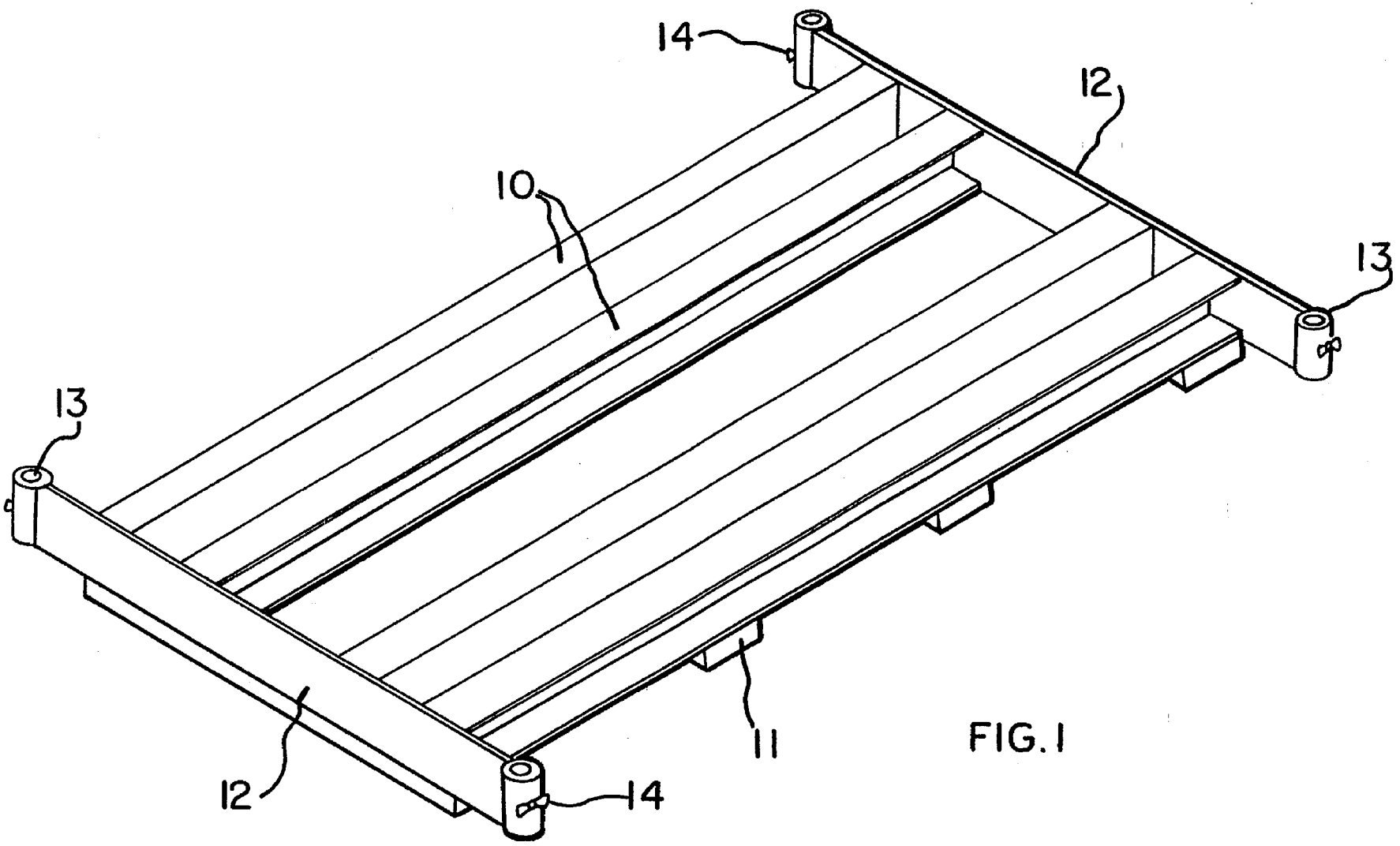
FIG. 1 is a perspective view of the apparatus base structure.
Figure 2:
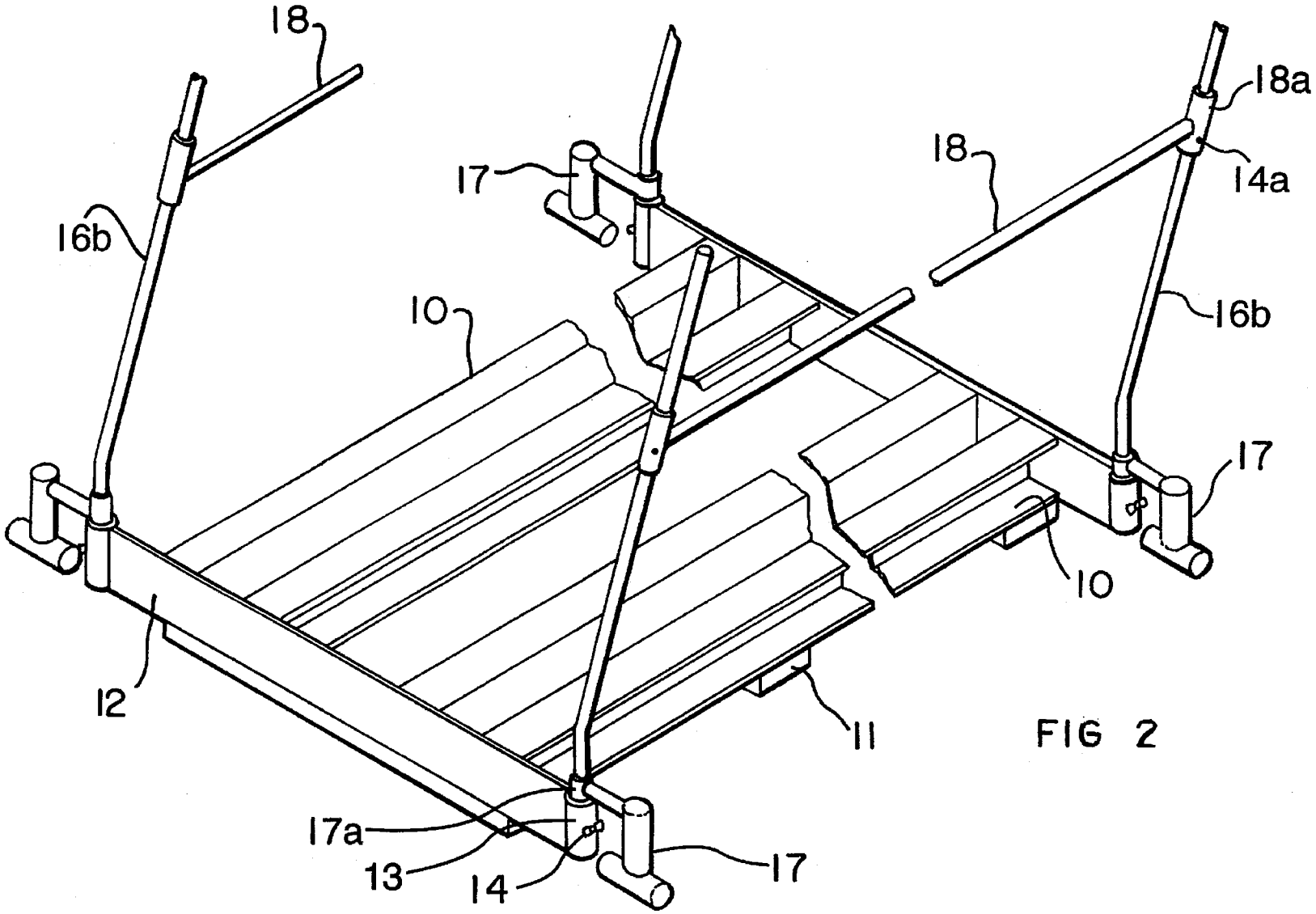
FIG. 2 is a perspective view similar to FIG. 1, showing the ancillary feet and parallel bars of the invention.

As seen in FIG. 1 the apparatus for performing multiple therapeutic and physical conditioning exercises is comprised of a shaped base defining two pairs of C-channel rails 10 interconnected by metal crossbeams 11 transversely extending thereunder. The base structure is closed both in the front and rear by a finishing plate 12 having ends including welded tubular segments 13 having anchoring bolts 14 therein. Reference is made to FIG. 2 where two pairs of ancillary feet 17 comprised of welded tubular lengths may extend from a collar 17*a* which is inserted into tubular member 13 and locked therein by bolt 14. A pair of parallel bars 18 having collars 18*a* are associated with each of four tilted poles 16*b*. The collars are provided with fastening bolts 14*a* for regulating the height of the collars. Each of the collars 18*a* are mounted to and slidable on tilted poles 16*b* to be at a desired height with respect to the shaped base defining the rails 10 and cross beam 11.

Figure 3:
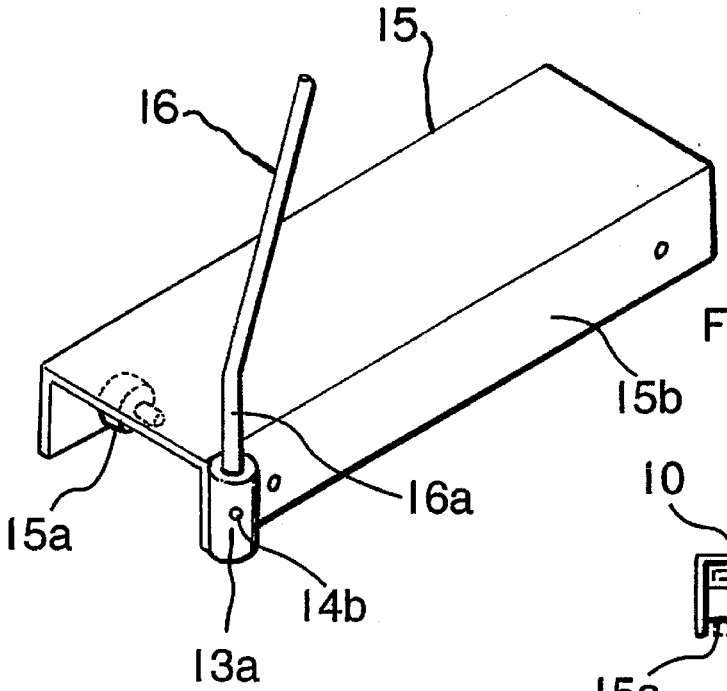
FIG. 3 is a perspective view of a skate per se incorporating a partially truncated pole.
Figure 4:
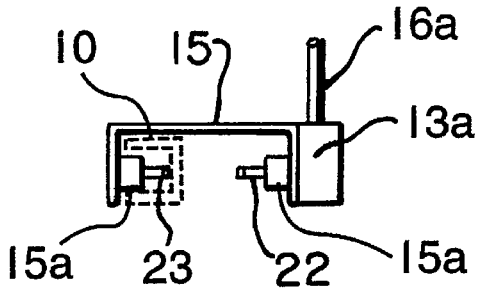
FIG. 4 is a front end view of the skate.

A pair of skates 15 (FIG. 3) are provided on their outer walls 15B with tubular segments 13*a* similar to tubular segments 13 and having anchoring bolts 14*b*. The skates are mounted on and move independently over the rails 10 so that two longitudinally aligned skate wheels 15*a* of the pair of skates 15 ride in opposed ones of each of the pairs of the longitudinally extending C-channel rails 10 (FIG. 4. A pair of tilted poles 16 each having a short straight lower segment 16*a* are fitted into tubular segments 13 on the skates 15.

Figure 5:
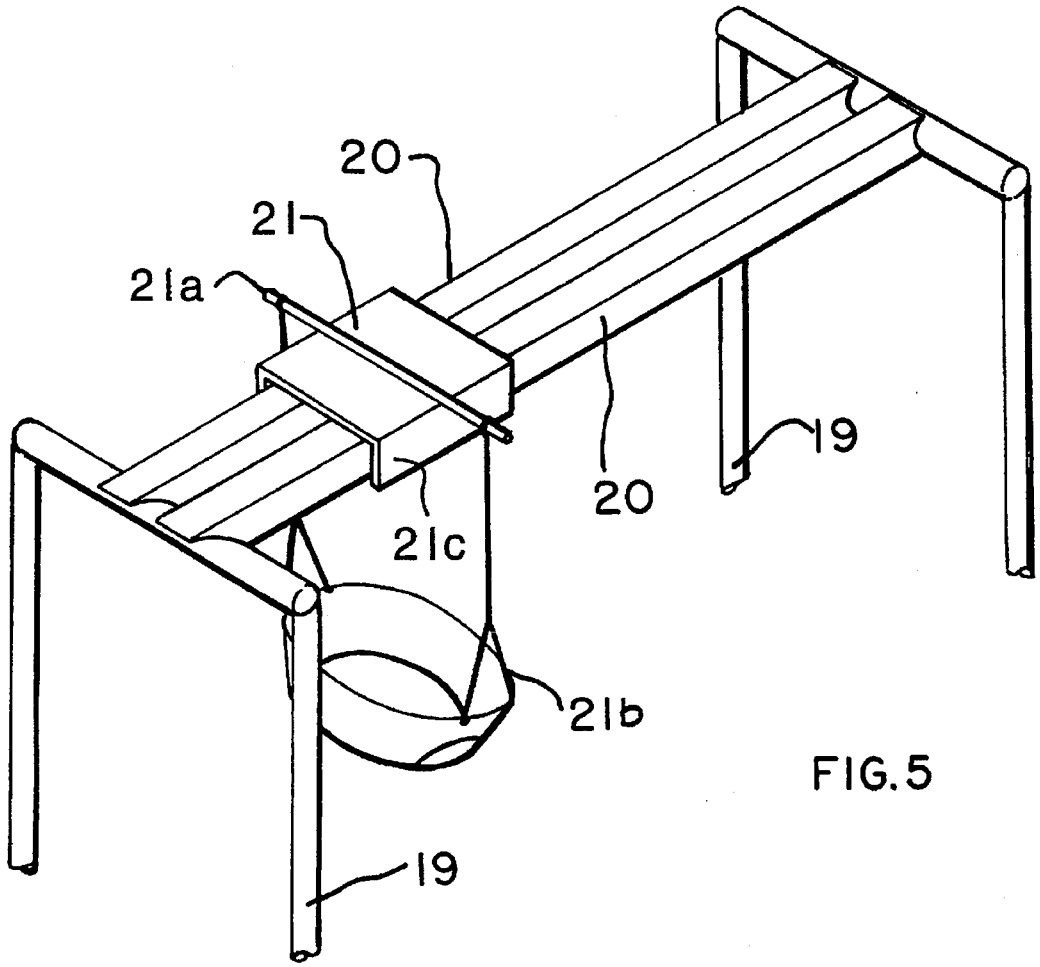
FIG. 5 is a perspective view of the support subassembly.

A supporting sub-assembly (FIG. 5) formed by pairs of substantially vertical U-bars 19 which may be coupled to ancillary feet 17 support a pair of upper rails 20 over which an inverted U-shaped support skate 21 is movable slidingly. The inverted U-shaped support skate 21 has depending side walls 21*c* laterally confining the skate on the rails 20. The support skate is provided on its top with a transverse rod 21*a* welded or otherwise affixed thereto for the attachment of a suspension vest 21*b*.The vest may be worn by a user and fits around the user's hips and chest to help support the user while the user's feet are placed on respective ones of the skates 15 riding on the base rails 10.

Each skate 15 is rollingly connected to two of the rails 10 in such a way that its wheels axially run along the inside of the upper legs of the rails. Each semi-axle 22 (FIG. 4) of each wheel extends as far as the end of a bolt head and is protected by a plastic cap 23 which contacts and runs along the upright vertical wall of each rail 10, thus providing the skate with enough stability and restraining any possible transverse clearance. The rails 10 are suitably covered by a plastic film such as a Teflon coating which protects the rail surfaces and allows for the free movement of the covered capped ends mentioned above.

The variety of kinds of exercises may be increased by positioning the poles 16*b* on the tubular segments 13 on the finishing plates located at the base ends at the external corners of said plates with or without the parallel bars 18.

Despite the fact that the apparatus has been specifically described with regard to the attached figures, it is to be understood that they illustrate preferred embodiments and possible changes which may not depart from the scope of the invention can be made thereto.

I claim:

1. An apparatus for performing multiple therapeutic and physical conditioning exercises comprising a shaped base including two pairs of longitudinally extending horizontal rails (10) interconnected by crossbeams (11) thereunder, each of said rails being in the form of a longitudinally extending C-channel including a vertical wall covered by a plastic film coating;

a pair of finishing plates (12) extending across terminal ends of said rails;

a single pair of wheeled skates (15) rollingly mounted on respective ones of said pairs of said rails for independent movement over a full length of said rails (10) between said plates, each of said skates having wheels riding in opposed ones of each of said C-channels, each wheel including a wheel semi-axle in the form of a bolt head and a plastic cap extending over an end of each bolt head, said plastic caps contacting and running along inner surfaces of said vertical walls allowing free movement of the capped ends of the semi-axles;

a pole (16) extending upwardly from and fixed to each wheeled skate;

means for removing and fixedly anchoring each said pole to its respective skate; and wherein a user exercises by standing on the single pair of wheeled skates and grasps his hands on said poles such that movement of said poles by a users arms provides movement of a users legs and said skates are independently movable over said rails.

2. The apparatus of claim 1 further comprising four tubular segments (13) extending essentially vertically from adjacent the ends of said finishing plates; support poles (16*b*) extending upwardly from said tubular segments; and parallel bars (18) extending from said support poles parallel to said rails.

3. The apparatus of claim 2 further including two pairs of auxiliary feet (17) extending from each of said tubular segments.

4. The apparatus of claim 3 further including a collar (18*a*) associated with each of said support poles, said collar being slidable for regulating the height of said parallel bars (18) with respect to said base.

5. The apparatus of claim 1 further comprising a supporting sub-assembly including a pair of bars (19) coupled to said base;

a pair of upper rails (20) connected to said bars (19) and extending above said base, said upper rails having a top surface; and an inverted U-shaped support skate (21) having a bottom surface, means for slidingly moving said support skate bottom surface on said top surface of said upper rails (20), said support skate (21) having side walls (21*c*) confining the support skate on the upper rails (20).

6. An apparatus for performing multiple therapeutic and physical conditioning exercises comprising a shaped base including two pairs of longitudinally extending rails (10) interconnected by crossbeams (11) thereunder, each of said rails having a longitudinally extending C-channel;

a pair of finishing plates (12) extending across terminal ends of said rails;

a pair of wheeled skates (15) rollingly mounted on respective ones of said pairs of said rails for independent movement over said rails (10), each of said skates having wheels riding in opposed ones of each of said C-channels; and pole (16) extending upwardly from each skate;

means for removing and fixedly anchoring said pole to its respective wheeled skate;

further comprising a supporting sub-assembly including a pair of bars (19) coupled to said base;

a pair of upper rails (20) connected to said bars (19) and extending above said base, said upper rails having a top surface;

an inverted U-shaped support skate (21) having a bottom surface, means for slidingly moving said support skate bottom surface on said top surface of said upper rails (20), said support skate (21) having side walls (21*c*) confining the support skate on the upper rails (20); and wherein said supporting sub-assembly includes a transverse rod (21*a*) fixedly attached to said support skate (21) and a suspension vest (21*b*) attached to and depending from said transverse rod for supporting a user while the user's feet are placed on said wheeled skates riding on the rails (10).

7. An apparatus for performing multiple therapeutic and physical conditioning exercises comprising a shaped base including two pairs of longitudinally extending horizontal rails (10) on a base, each rail having a longitudinal C-channel including a vertical wall covered by a plastic film coating;

a pair of finishing plates (12) extending across terminal ends of said rails;

a single pair of wheeled skates (15) rollingly mounted on respective ones of said pairs of said rails for independent movement over a full length of said rails (10) between said plates, each of said skates having horizontally aligned wheels riding in opposed ones of said rail longitudinal channels, each wheel including a wheel semi-axle in the form of a bolt head and a plastic cap extending over an end of said bolt head, said plastic caps contacting and running along inner surfaces of said vertical walls allowing free movement of the capped ends of the semi-axles;

a pole (16) extending upwardly from each skate;

means for removing and fixedly anchoring said pole to its respective wheeled skate; and wherein a user exercises by standing on the single pair of wheeled skates and grasps his hands on said poles such that movement of said poles by a users arms provides movement of a users legs and said skates are independently movable over said rails.

* * * * *